US006966846B2

(12) United States Patent
Bloom, Jr.

(10) Patent No.: US 6,966,846 B2
(45) **Date of Patent: *Nov. 22, 2005**

(54) COUNTERWEIGHTED GOLF CLUB

(76) Inventor: James Pierce Bloom, Jr., 3505 Mill Springs Rd., Birmingham, AL (US) 35223-1653

( * ) Notice: Subject to any disclaimer, the term of this patent is extended or adjusted under 35 U.S.C. 154(b) by 30 days.

This patent is subject to a terminal disclaimer.

(21) Appl. No.: 10/341,542

(22) Filed: Jan. 13, 2003

(65) Prior Publication Data

US 2003/0157990 A1 Aug. 21, 2003

Related U.S. Application Data

(63) Continuation-in-part of application No. 09/420,128, filed on Oct. 19, 1999, now Pat. No. 6,506,128.

(51) Int. Cl.[7] ..... A63B 53/00
(52) U.S. Cl. ..... 473/292; 473/297; 473/300
(58) Field of Search ..... 473/292, 294, 473/297, 300

(56) References Cited

U.S. PATENT DOCUMENTS

| | | | | |
|---|---|---|---|---|
| 1,210,182 A | | 12/1916 | Lynch | |
| 1,658,447 A | | 2/1928 | Lantz | |
| 1,673,361 A | | 6/1928 | Heeter | |
| 1,677,099 A | | 7/1928 | Harness | |
| 1,696,462 A | | 12/1928 | Victor | |
| 1,890,037 A | | 12/1932 | Johnson | |
| 1,974,271 A | | 9/1934 | Hackett | |
| 2,221,421 A | * | 11/1940 | Curry | 473/300 |
| 2,782,035 A | | 2/1957 | East | |
| 3,679,207 A | | 7/1972 | Florian | |
| 3,999,765 A | * | 12/1976 | Bishop | 473/238 |
| 4,067,573 A | | 1/1978 | Key, Jr. | |
| 4,215,860 A | | 8/1980 | Nakamatsu | |
| 4,272,077 A | | 6/1981 | Spivey | |
| 4,461,479 A | | 7/1984 | Mitchell | |
| 4,537,403 A | | 8/1985 | Farina | |
| 4,600,195 A | | 7/1986 | Hunter | |
| 4,605,228 A | * | 8/1986 | Guendling, Jr. | 473/409 |
| 4,674,746 A | | 6/1987 | Benoit | |
| 4,795,158 A | | 1/1989 | Kuykendall | |
| 4,869,511 A | * | 9/1989 | Spoonster, Sr. | 473/203 |
| 4,887,815 A | | 12/1989 | Hughes et al. | |
| 4,971,321 A | | 11/1990 | Davis | |
| 4,988,102 A | * | 1/1991 | Reisner | 473/297 |
| 5,152,527 A | | 10/1992 | Mather et al. | |

(Continued)

FOREIGN PATENT DOCUMENTS

| | | |
|---|---|---|
| EP | 0294107 | 5/1988 |

(Continued)

*Primary Examiner*—Stephen Blau
(74) *Attorney, Agent, or Firm*—Bradley Arant Rose & White LLP

(57) ABSTRACT

A conventional length golf club with a grip including a heavy counterweight, the mass of which is sufficient to cause the center of gravity of the whole golf club to be located within the boundaries of the grip. The counterweight may be an elongated member with a bore through its interior, and in order to achieve the object of placing the center of gravity within the boundaries of the grip, it must have a substantially larger cross-section than the standard-diameter shaft of a golf club. The grip may include a lower support section made of a substantially less massive material than the counterweight. In a preferred embodiment, the grip has an elliptical cross section with the major axis of the ellipse perpendicular to the face of the club head.

11 Claims, 4 Drawing Sheets

U.S. PATENT DOCUMENTS

| | | | | | |
|---|---|---|---|---|---|
| 5,203,561 | A | | 4/1993 | Lanctot | |
| 5,244,209 | A | | 9/1993 | Benzel | |
| 5,277,059 | A | | 1/1994 | Chastonay | |
| 5,364,102 | A | | 11/1994 | Appledorn | |
| 5,423,546 | A | * | 6/1995 | Manning et al. | 473/331 |
| 5,465,967 | A | | 11/1995 | Boeckenhaupt | |
| 5,554,078 | A | | 9/1996 | Hannon et al. | |
| 5,632,691 | A | * | 5/1997 | Hannon et al. | 473/292 |
| 5,653,644 | A | | 8/1997 | Jaeckel | |
| 5,686,158 | A | * | 11/1997 | Gibbon | 428/36.92 |
| 5,913,733 | A | * | 6/1999 | Bamber | 473/317 |
| 6,048,275 | A | * | 4/2000 | Gedeon | 473/293 |
| 6,372,323 | B1 | * | 4/2002 | Kobe et al. | 428/119 |

FOREIGN PATENT DOCUMENTS

| | | |
|---|---|---|
| GB | 11118 | 7/1901 |
| GB | 20882 | 4/1909 |
| WO | 83/01578 | 5/1983 |
| WO | 89/00875 | 2/1989 |

* cited by examiner

COUNTERWEIGHTED GOLF CLUB

This application is a continuation-in-part of patent application Ser. No. 09/420,128 filed on Oct. 19, 1999 now U.S. Pat. No. 6,506,128 and claims priority thereto.

BACKGROUND OF THE INVENTION

Too often tradition drives design, and golf is an ancient sport. When golf was invented some 500 years ago, a simple stick was state-of-the-art. Featured today, and for all practical purposes unchanged for half a millennia, the maximum diameter of the handle end of a typical golf club shaft is about half an inch. This small diameter may be necessary with full-swing clubs, because of the different functions of the left and right hands—the lower hand finger grip must roll the club over near impact while the upper hand balances the club under the heel pad of the palm. However, because the hands perform similar functions in a putting stroke, this small diameter grip is unnecessary.

In fact, the full swing and putting stroke are entirely different. In a full swing, the golfer's feet, legs, hips, and shoulders are in motion: the body dominates the swing. Conversely, during a preferred putting stroke, the club dominates the stroke. The body remains nearly motionless, with the arms acting as an extension of the club to form a simple pendulum. Full-swing clubs may be swung at speeds of one hundred miles an hour or more, driving the recent emphasis on lightweight materials such as graphite and titanium. Compared to these clubs, the putter carries out its function at a near stand-still, and such a primary emphasis on lightweight design would be misplaced. In short, putters perform a very different function than the other thirteen full-swing clubs, yet the design of putters—especially their grips—is in many ways the same.

Control and accuracy are possibly more important in putting than in any other aspect of the golf game. No longer is the golfer's target a fairly large area in the fairway, perhaps several hundred yards away, or even the somewhat smaller area defined by the green. Rather the target is the tiny cup into which the golfer must roll the ball. The golfer must strike the ball along a precise line with a precise speed, taking into account both the contour and texture of the green's surface, in order to sink a putt. Unfortunately, with a typical prior art putter, there are many forces acting on the putter in several different directions during the putting stroke. Hence, it is the golfer's job to counteract these forces such that the sum of the magnitudes and directions of all the various forces involved results in the putter's applying exactly the right amount of force in exactly the right direction. This is no easy task. But the task can be simplified by minimizing the effect of an imperfect putting stroke, and reducing the number of dissonant forces the golfer must counteract in order to strike the ball with the requisite force and direction.

An imperfect putting stroke may result in the club head (or blade) being struck off-center, which may cause the putter to twist in the golfer's hands and lose the all-important line. A club's resistance to this twisting is a function of the club's moment of inertia. More specifically, the moment of inertia of a golf club affects the club's resistance to rotating about an axis defined by its shaft when the golf ball is struck away from the center of percussion (or sweet spot) of the club head. An increase in the magnitude of the moment of inertia of a golf club, and particularly the putter, is a desirable object of golf club design. This object has been recognized, as designs incorporating heel-toe weighting in the club head to increase the moment of inertia of the club account for approximately eighty percent of putters on the market today, according to a recent survey. Many of these designs use sophisticated and complex heel-toe or perimeter weighting systems and exotic and extremely heavy materials such as tungsten or special alloys. While they have increased the moment of inertia somewhat, it would be most desirable to increase the moment of inertia by an order of magnitude or more.

Another important design parameter, one which affects the feel and balance of the putter in the golfer's hands as it is positioned behind the golf ball and moved through the putting stroke, is the location of the entire putter's center of gravity, as opposed to the center of gravity of just the blade. Prior art designs have added weight to various places in the club, to alter the location of the center of gravity. A typical design adds a relatively small amount of weight, as compared to the overall weight of the golf club, within the club shaft at the handle end of the club. The added weight moves the center of gravity up the club shaft towards the grip end of the club marginally, but to the inventor's knowledge no design that adds weight exclusively within the inside of a standard diameter club shaft can move the center of gravity of the putter so far as to locate it actually in the region of the club gripped by a golfer, while maintaining a conventional length club.

Consequently, the center of gravity of the whole club in a typical prior art putter is generally located in the shaft somewhere between six inches or more below the lower end of the grip and a few inches above the head. As the golfer grips the club, the hands form a pivot and, because the center of gravity of the club is some distance from the hands, the shaft serves as a torque arm. The club itself thus exerts a torque or pull on the hands that is a product of the mass of the club (directed through the center of gravity) and the length of this torque arm. As a result, the club feels "bottom heavy." The relatively light weight of a typical club head (eight ounces or so) would seem to be a small input into the function of the swing. However, in a prior art putter the club head accounts for at least half of the weight of the whole club, and the club head's weight is multiplied over the long lever arm from the grip to the center of gravity. Consequently, the club head's weight causes a large, hard to control, output during the swing. Moreover, because each of the golfer's hands is a different distance from the center of gravity of the club, the golfer must apply different forces with each hand to maintain the club's position. To make matters worse, the bottom-heaviness of a typical putter exerts a torque on the golfer's hands during the stroke. This torque is a function of the angle of the club from vertical, so that as the club moves through the putting stroke the torque is constantly changing. Then one must add into the equation the vacillations and fluctuations of the average golfer as he attempts to balance this constantly changing force applied differently to each hand, possibly under the intense pressure of a golf game.

These problems with the bottom-heavy design may be explained in terms of equilibrium. An object is in equilibrium when the sum of the forces acting upon it is zero. Further, an object may be in unstable equilibrium or in neutral equilibrium. When an object is in unstable equilibrium, any displacement away from its equilibrium position will cause the object to tend further away from equilibrium. If in the physical system of a golfer gripping a putter, the fulcrum is taken to be the normal pivot at the golfer's hands on the handle, a typical prior art putter is in unstable equilibrium. Thus the inherent difficulties described above.

When an object is in neutral equilibrium, on the other hand, any displacement of the object away from a first equilibrium position will result in the object's being in equilibrium at its new position. In other words, when one moves an object in neutral equilibrium from a first position to a second position, the object tends to stay in the second position. A golf putter in neutral equilibrium would be advantageous to the golfer because it would minimize, or possibly even eliminate, many of the varying forces that the golfer must otherwise counteract.

In addition to its instability and relatively small moment of inertia, the small diameter grip of a typical prior art putter tends to place the control of the putting stroke in the small, twitchy muscles of the hands and forearms. The small diameter grip promotes much more of a finger grip, rather than a preferred palm grip for putting, which may result in the golfer clenching the club with the fingers and placing a heavy load on the small finger muscles. This small grip, in conjunction with the bottom heaviness of the traditional design, requires the golfer to apply force with the smaller, twitchy, and unreliable muscles of the wrists and forearms to counteract the dissonant forces described above, even as the golfer addresses the ball prior to beginning the putting stroke.

Another problem caused by the bottom-heavy design of most prior art putters is that as the putter is swung back, the handle end tends to move ahead of the club head. Given the linear, rigid characteristics of a typical putter, and its concentration of weight toward the club head, as the putter is pulled by its lighter end (the handle end), the greater inertia of the club head requires a greater force to move it from its resting position, thus creating a tendency for the handle to move first. This non-uniform movement causes the imaginary line formed by shaft up through the arms to the shoulders to be broken at the hands during the swing, effecting a chaotic double pendulum. The problem is exacerbated by the fact that the pendulum's bob is the putter's head. This double-pendulum effect is undesirable in light of the commonly preferred method of swinging a putter, which is to pivot only at the shoulders, keeping the wrists locked, thus simulating a simple single-pendulum swing.

Moreover, the typically circular cross-section of most prior art grip designs does not assist the golfer in hand placement. A circular grip feels the same no matter which way it is held; the golfer must rely on visual cues to properly grasp and align the club.

Ergonomics may be defined as the relationship of man to machine. Simply put, each of the preceding characteristics of conventional putter design impairs the overall ergonomics of the club. A more ergonomic design is needed.

Finally, many commercially successful putters have complex and sophisticated heel-toe or perimeter-weighting systems and use exotic materials. These exotic materials, such as elastomer, tungsten or special alloys, and the materials science research involved in developing them, make putters expensive. In addition, complex designs may require special manufacturing processes, driving up costs even more.

Hence, there exists a need for a golf putter with a high moment of inertia; that does not have a bottom-heavy feel; that maintains its equilibrium throughout the putting stroke; that does not primarily engage the small, twitchy muscles of the hands and forearms; that has a grip shape which promotes proper hand placement; that increases the overall ergonomics of the club; and that is simple and inexpensive to manufacture.

SUMMARY

The present invention satisfies these needs by providing a golf club with a high moment of inertia, that has its center of gravity in its grip, that has increased overall ergonomics, that maintains its equilibrium throughout the putting stroke, that primarily engages the large, stable muscles of the shoulders and back, that has a grip shape which promotes proper hand placement, and is simple and inexpensive to manufacture. A club according to the present invention includes a shaft with a lower head end and an upper handle end, a club head attached to the head end, and a grip attached to the handle end, the grip including a heavy counterweight. The mass of the counterweight is sufficient to place the center of gravity of the club actually within the boundaries of grip, and hence, within a golfer's hands as he or she grasps and swings the club. The grip may include two distinct sections: an upper portion made of some heavy material, such as lead, and a lower portion of substantially the same cross-section as the upper portion, but made of a less dense, lighter material, such as a hardened polymer or elastomer (e.g., polyurethane). This design allows precise placement of the center of gravity of the club by varying the relative sizes of the upper and lower portions of the grip. The shape of the grip's cross-section may be round, elliptical, triangular, triangular with rounded edges, hexagonal, octagonal, or any other polygonal or other shape desired by a particular player. A grip with a uniform, elliptical cross-section oriented with the major axis of the ellipse perpendicular to the face of the club head is preferred.

It is an object and advantage of the present invention to provide a golf club that increases a golfer's accuracy and therefore improves golf scores.

A further object and advantage of the present invention is to place the center of gravity of the entire golf club within the grip and therefore within a golfer's gripping hands as he or she swings the club.

Another object and advantage of the present invention is to substantially increase the moment of inertia of the golf club about the axis defined by its shaft and therefore minimize the tendency of the club to twist if the golf ball is struck away from the center of the club face and to insulate the stroke from the effects of unintentional and external forces.

A still further object and advantage of the present invention is to effectively enlarge the sweet spot on the club face.

Yet another object and advantage of the present invention is to provide a golf club that maintains a state of neutral equilibrium, and therefore eliminates the bottom-heavy feel of the golf club at address, making the club head feel seemingly weightless as a golfer addresses the ball.

A further object and advantage of the present invention is to provide a gripping surface with increased ergonomics, which will promote a palm grip by both of the golfer's hands, which will decrease the golfer's tendency to tightly clench the club, and which will result in a light grip pressure.

A still further object and advantage of the present invention is to facilitate consistent and optimal hand placement on the grip relative to the orientation of the club head, so that the golf ball may be more easily struck along the intended target line each and every time.

Another object and advantage of the present invention is to promote reliance on the large, reliable muscles of the upper arms, back, and shoulders at address and during the putting stroke and to minimize the use of the small, twitchy muscles of the hands and forearms in supporting and guiding the club.

Yet another object and advantage of the present invention is to lock the wrist in order to minimize wrist movement during the putting stroke and to promote a simple and preferred single-pendulum stroke.

Another object and advantage of the present invention is to provide a golf club with improved dynamic characteristics that help orient and align the palm-to-elbow-to-shoulder position during the putting stroke.

A further object and advantage of the present invention is to allow the golfer to apply equal forces through each gripping hand during the putting stroke and therefore simplify the dynamic properties of the putt.

A still further object and advantage of the present invention is to dampen vibrations translated to the golfer's hands from impact.

DESCRIPTION OF THE DRAWINGS

These and other features, aspects, and advantages of the present invention will become better understood with regard to the following description, claims, and accompanied drawings where:

FIG. 3(*b*) is a perspective view of the grip of FIG. 3(*a*);

FIG. 4(*b*) is a side view of a prior art putter in which weight has been added to the shaft according to the prior art, showing the movement of the center of gravity in such a device;

DETAILED DESCRIPTION

Figure 1:
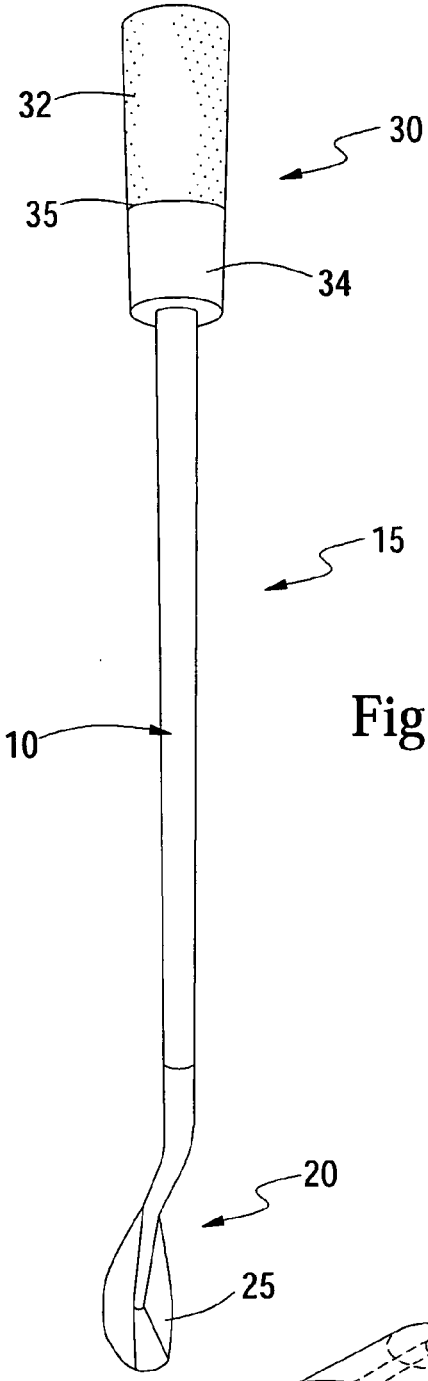
FIG. 1 shows a front view of a preferred embodiment of the invention.

As shown in FIG. 1, a golf club 15 comprises shaft 10, head 20, and grip (or handle) 30. The head 20 is attached to the lower end of the shaft 10, which will be referred to as the head-end of the shaft. Similarly, the grip 30 is attached to the upper end of the shaft 10, which will be referred to as the handle-end of the shaft.

The shaft 10 may be a standard golf club shaft, and it may be made of steel, graphite, or other material(s). The shaft is of a standard length and weight. The head 20 may be any type of golf club head or blade that the golfer desires. Regardless of the particular structure or design of the club head, almost all club heads include an elongated, substantially flat surface 25, referred to as the face, with which the golf ball is to be struck. Many, many head designs are currently being manufactured and are well known to those skilled in the art. Any method of attachment of the shaft 10 to the head 20 is acceptable. Such methods include adhesive means, using such as epoxy or some other adhesive material; or mechanical means such as threading, set screws, swaging, welding, brazing, soldering, or a simple friction fit; or a combination of mechanical and adhesive means. Likewise, the place on the head to which the shaft is attached is not critical. The shaft may attach to the heel of the club head or more towards its center, and the head may be offset or in line with the shaft as desired. The only parameter of the head that is of particular importance to the present invention is its weight, which is important only insofar as it impacts the mass of the counterweight to be used in the grip, as discussed further below.

Figure 2:
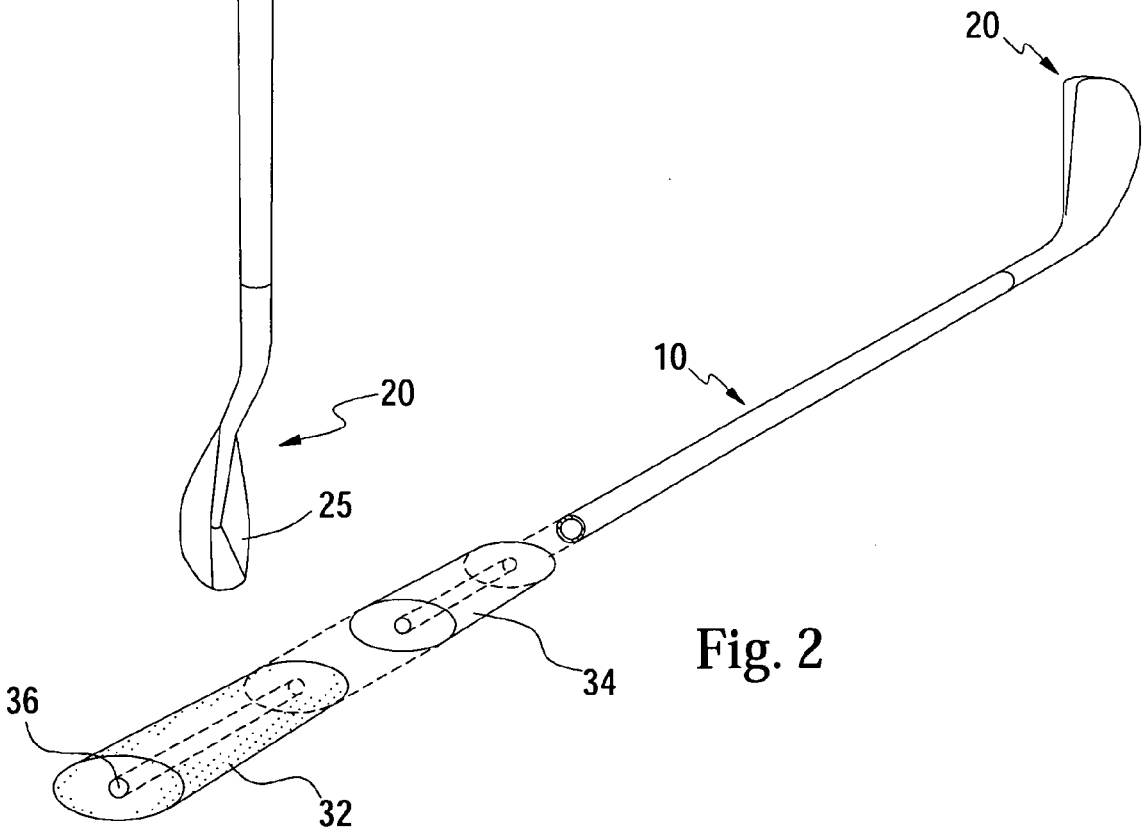
FIG. 2 shows a perspective exploded view of the embodiment of FIG. 1.

Central to the invention is the massive, counterweighted grip 30. The grip comprises a counterweight 32 and a lower support 34. Counterweight 32 may be an elongated member made of lead or some other suitably heavy material, such as iron, steel, tungsten or granite, and the lower support 34 is made of some less massive material, such as a viscoelastic material (e.g., sorbothane), a closed-cell or open cell foam, a hardened polymer, or elastometer (e.g., polyurethane) (hereinafter generally referred to as polymer), which is lightweight but nevertheless provides a supportive surface for a golfer's gripping hand. The cross section of the counterweight 32 and the lower support 34 may be of any shape a golfer desires, including round, elliptical, rounded triangular, various other polygonal shapes, and it may be asymmetrical as well. The counterweight and lower support also may be of dissimilar cross sections. As shown in FIG. 2, a preferred embodiment of the present invention includes a grip with an elliptical cross-section, with the major axis of the ellipse perpendicular to the face of the head 20. Also shown in FIG. 2, the counterweight 32 and lower support 34 have a bore 36, the diameter of which is coincident with the outer diameter of the shaft 10 at its handle end. (Some golf shafts are tapered, in which case bore 36 likewise would be tapered, and other golf shafts may be of a uniform cross-section, in which case bore 36 is likewise uniform.) In a preferred embodiment, the bore 36 is through the central longitudinal axis of the grip. However, the bore need not be through the central axis, depending on the preferences of an individual golfer or a desired feel of the club. The lower support may be spaced apart from the counterweight.

In a preferred embodiment, the shaft 10 is passed through the bore 36 in the counterweight 32 and the lower support 34 and is fixedly attached thereto. Any mechanical or adhesive means, or combination thereof, for attaching is suitable. Such means include threading, set screws, welding, a simple friction fit, epoxy, glue, or other adhesive materials, as discussed below. The top of the shaft 10 may be positioned flush with or recessed from the end of bore 36 at the upper end of counterweight 32. Some golfers may prefer that shaft 10 is attached to the grip 30 in such a way that it may be removed, such as by a set screw or threading, in order that the golfer may adjust the weighting of the club with substitute counterweights or change the shape of the grip as desired. A removable counterweight is permissible under the rules of golf, so long as the adjustment cannot be readily made; all adjustable parts are firmly fixed and there is no reasonable likelihood of their working loose during a round; and all configurations of the adjustment conform with the rules. A putter according to the present invention can be designed to comply with these rules, for example by using a recessed hex-head-type screw to fix the position of the grip, such that the adjustment is not readily made and will not likely work loose during a round.

The assembled putter according to the present invention is intended to be a conventional length putter, as in contrast to the "long" putters seen used by some golfers today. With a conventional length putter, the golfer typically stands over the club as he addresses the ball, whereas with a long putter the golfer tends to hold the putter in front of him as he addresses the ball. According to Golf Club Design, Fitting, Alteration, and Repair: The Principles and Procedures (4th ed.) by Roger Maltby, conventional length putters are predominantly 33 to 36 inches long, with the average men's putter being 34 to 35 inches, and the average women's putter being 33 to 34 inches. In contrast, a typical long putter is 48 inches, but some are even longer. For purposes of the present invention therefore, a conventional length putter is defined as the type over which a golfer stands as he addresses the ball, and is usually no shorter than 30 inches or longer than 40 inches If (though there could be exceptions for extremely short or tall golfers). On a conventional length putter (as just defined), the typical grip is usually about one-fourth to one-third of the length of the club. A putter according the present invention typically has a grip 30 in the range of seven to fifteen inches, depending on the counterweighting required, materials used, and preferences of the individual golfer.

Novel features of the grip 30 of the present invention include its extreme weight and large cross-section, as compared to typical grips in the prior art, and the effect of these features on the location of the center of gravity, the moment of inertia, and the overall ergonomics of the club. The weight of the grip is best described in functional terms. The counterweight 32 must be of sufficient mass to cause the center of gravity of the entire club to be contained within the boundaries of the grip. To further clarify, in a conventional length putter, the golfer grips, with hands near or touching one another, the club between the top of the shaft and about twelve inches down from the top of the shaft. Therefore, the region of shaft between the shaft/lower hand boundary and upper hand/shaft boundary is this special location for the center of gravity of a putter according to the present invention. A tremendous change in the static and dynamic properties of the club occurs when there exists enough weight to cause the gripping hands to become a balanced fulcrum. The mass of the club head multiplied by the long lever or torque arm of the shaft must be counterbalanced by a heavy but short effort arm formed by the grip, in order to achieve equilibrium. The center of gravity should lie between a golfer's hands as he grasps the club on the grip 30. In contrast, weight added to the handle end of the shaft in an amount that is insufficient to move the center of gravity into the grip region does not so improve the static and dynamic properties of the club. It simply makes the club heavier.

Figure 4A:
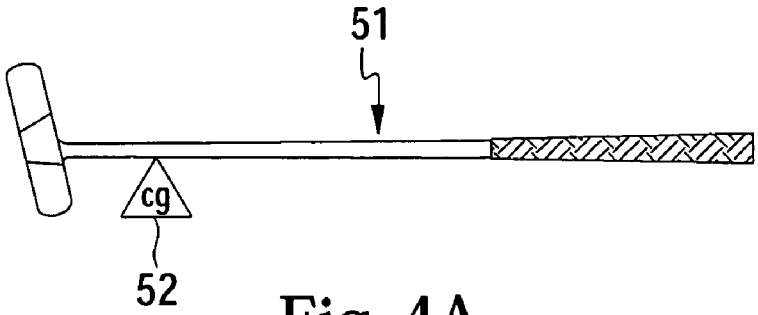
Fig. 4A Prior Art
FIG. 4(*a*) is a side view of a typical prior art putter showing the location of the center of gravity.
Figure 4B:
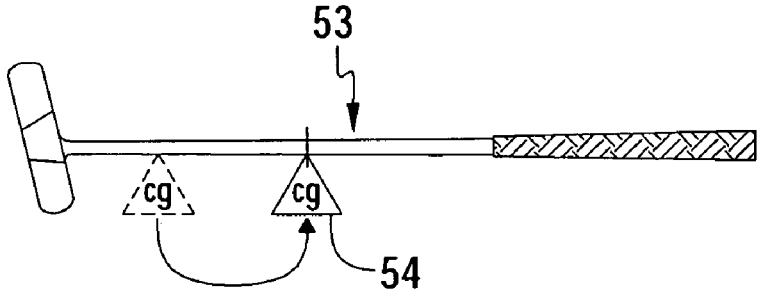
Fig. 4B Prior Art
Figure 5:
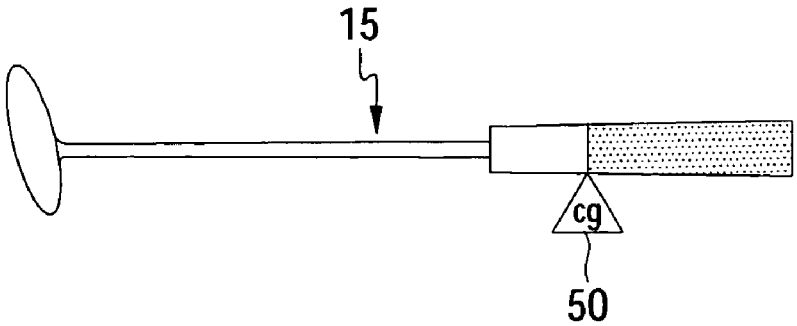
FIG. 5 is a side view of an embodiment of the present invention, showing the location of the center of gravity within the boundaries of the grip of the device.

FIGS. 4(*a*) and 4(*b*) show the locations of the center of gravity in typical putters of the prior art. FIG. 4(*a*) shows the location of the center of gravity in a prior art putter 51 in which no extra weight has been added to the handle end of the shaft. As shown, the center of gravity in such a club is located toward the head end of the club at position 52. Other prior art designs, such as a putter 53 shown in FIG. 4(*b*), add small amounts of weight (relative to the amount of weight added by the present invention) to the handle end of the club, and the center of gravity is moved from position 52 towards the center of the shaft at position 54. As shown in FIG. 5, the center of gravity of a putter 15 according to the present invention is located toward the handle end of the shaft, actually within the boundaries of the grip itself, at position 50.

Figure 3A:
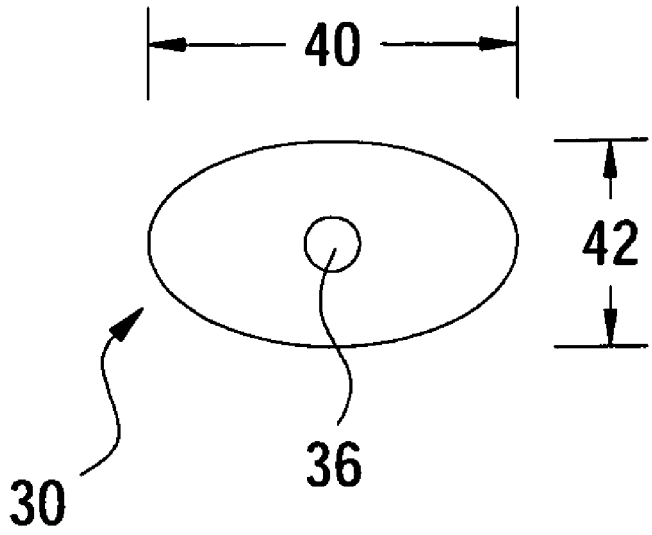
FIG. 3(*a*) is a cross-sectional view of the grip of the embodiment of FIG. 1.
Figure 3B:
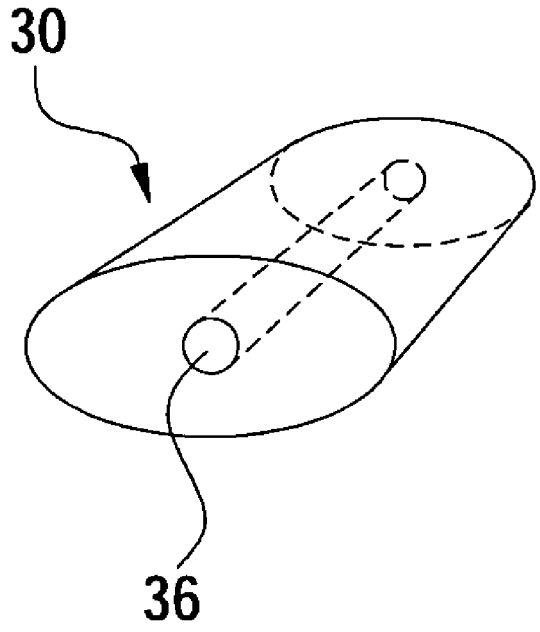

In order to cause the center of gravity to move so far up the club toward the handle end of the shaft, the counterweight 32 must account for a majority of the club's total mass. Depending on the preferences of an individual golfer and the weight of the head and the weight and length of the shaft, the counterweight could vary from one-half to as much as ten pounds. The optimal counterweight is in the range of three to six pounds. In contrast, most prior art putters have a total weight between fifteen and eighteen ounces, according to Maltby's Golf Club Design. In order to achieve the mass required by the present invention, it is necessary that the grip be of a large diameter, relative to the diameter of the shaft. It is simply not possible to sufficiently weight the club by adding weight only within the interior of a standard shaft or by adding weight within the cross-section of a conventional grip (usually no greater than one-half inch). Under the rules of golf, the maximum permissible diameter of a grip is 1.75 inches. As shown in FIG. 3(*a*), in a preferred embodiment of the invention an elliptically shaped grip 30 has a major axis 40 of 1.75 inches in length, and a minor axis 42 approximately one-inch long. (Of course, a putter according to the present invention may be designed without regard to the rules of golf, if desired.) The large diameter of the grip has several advantages, discussed in more detail below, including a better fit and feel in the palm of a golfer's hands, and an increase in the moment of inertia of the club. Using the lower support 34 made of a less massive material facilitates proper concentration of the mass of a club towards the handle end, in order to position the center of gravity within the boundaries of the grip. The ratio of the length of the lower support 34 to the length of the counterweight 32 may be varied (and thus the total mass of grip 30 varied) to place the center of gravity in a precise location, as desired. In another embodiment, a similar distribution of weight at the handle end of the club could be effected by tapering the counterweight 32 such that it is of a larger cross section at its top end than at its bottom end, in which case the smaller diameter lower end of the counterweight would act as a lower support, eliminating the need in such an embodiment for a separate lower support of less dense material.

It is a simple empirical determination, based on the weight of the club head and weight and length of the club shaft and desired placement of the center of gravity within the grip, to determine the mass and length of the counterweight 32 and the mass and length of lower support 34. In a preferred embodiment, the counterweight 32 weighs 4 pounds, 7 ounces; is of a uniform elliptical cross section, with a 1.75 inch major axis and a 1 inch minor axis; and is 7.5 inches in length. The lightweight lower support 32 weighs 4 ounces, is 4 inches long, and is of the same cross section as the counterweight. The club head weighs 8.2 ounces, and the total club length is 36.5 inches.

A curved or twisted lower support may be employed to enable ergonomic hand positioning for the heavier counterweighted grip. Various shapes and designs for ergonomically shaped grips, and grips designed to teach hand placement, are taught in the art. As noted above, the grip may also be asymmetric in shape.

The grip may be wrapped with a thin rubberized tape or other covering as desired by an individual golfer. Such a covering may improve the touch and feel of the grip. Alternatively, a sheath made of some rigid material and in contact with the exterior of the counterweight 32 may be used. Such a sheath may extend beyond the lower end of the counterweight and may act as a lower support 34, eliminating the need for a polymer lower support. Alternatively, the outer perimeter of the counterweight material itself may be extended downward to form a thin tube-like, hollow lower support 34. In either case, the hollow lower support may or may not have a closed lower end in contact with the golf shaft. In another embodiment, the lower support may be formed by wrapping the bare shaft, where the lower support is to be located as described herein, with a build-up tape to enlarge the diameter of this region such that it forms a lower support. In other words, the shaft is expanded radially until it meets the outer perimeter of the counterweight. The two regions then may be covered with any grip covering material discussed herein.

Various materials and methods of making a covering for the grip may be used. A covering made of conventional materials, enlarged to fit the grip disclosed herein, may be placed over the counterweight and lower support in the same manner that such coverings are currently placed over regular shafts. Alternatively, the grip disclosed herein may be dipped into a liquid material, such as a resin or polymer, that then may be cured to form a layer that will be the grip covering surface. A sheet material may be applied to the outside of the grip, and secured in place by conventional means.

An alternative embodiment of the present invention comprises only a counterweighted grip, as described herein, which would be retrofitted onto an existing putter. Such counterweighted grips could be designed to place the center of gravity within the grip of mass-manufactured putters and sold as an aftermarket enhancement. For example, a counterweighted grip of a specific size and weight, possibly including a lower support, could be designed to match a specific manufacturer's make and model putter. The counterweighted grip may include a means for attaching it to the shaft of the previously manufactured putter, as described in more detail herein. A kit may be included with appropriate adhesive or curable material, as described below. By using such a material, and the method of attachment described below, a counterweight with one, enlarged internal bore 36 could be fitted to a wide variety of manufacturer's shafts, having different diameters and shapes. Also, any of the embodiments of a lower support described herein could be sold either with or separately from the counterweight, such that a golfer may select the lower support most suitable to his preferences. Alternatively, the counterweight and lower support could be a one-piece unit, as set forth above.

Manufacturing the present invention is simple and inexpensive. In a basic embodiment, it is simply a 5–10 inch lead cylinder, about 1–1.75 inches in diameter, with a bore through the center. Such a device can be manufactured with existing technology and processes at little cost. Moreover, due to the impact of the counterweight on the putting stroke, described in detail below, complex head designs employing sophisticated or expensive materials are not needed, bringing down the cost of the entire club.

In addition to the mechanical or adhesive methods of attachment of the counterweighted grip to a golf club as described above, a golf club embodying the present may be assembled in other ways. In one method, the counterweight is placed on a surface, with the counterweight's lower end (and thus its bore 36) outwardly directed. The club shaft is guided into the bore and held in place. A curable adhesive or fill material (such as a resin or other suitable polymers known in the art) is then injected into the bore 36 in order to fill any gap between the outer surface of the shaft and the inner surface of the bore 36. One method of assembling the club this way is to use gravity to align the shaft. Specifically, the counterweight is placed on a level, horizontal surface and the shaft is suspended vertically shaft from its head end. The grip-end of the shaft is lowered vertically through the counterweight's bore using gravity to align plumb. A suitable material is then injected into the bore 36 as previously described.

A combined lower support and outer covering may be made using a mold. A suitable counterweight is attached to a shaft by any method described herein. A mold is provided with an interior void extending the desired length of the grip. The shape of the interior void of the mold corresponds to the outer surface of the grip, but is sized slightly larger than the grip. The counterweight-shaft assembly is placed into the mold. The space between the mold and the counterweight-shaft assembly is filled with a curable material, such as a resin, epoxy, suitable polymers, or other materials known in the art. The material is then cured. When the material has set, this material serves both as the lower support and outer covering of the grip. By this method, there would be no need for a separate adhesive, because the material itself acts as the adhesive. The material also has gap-filling (therefore vibration-controlling) properties which will almost perfectly fit, or "flush", what becomes the interior bore of the newly-created lower support with the shaft's actual outer shape (e.g., tapering, step-downs, or any deviation from a simple rod form). The completed assembly is removed from the mold after the material has set.

As described above, the counterweight, in order to add the required mass to move the center of gravity of the whole golf club into the region defined by the boundaries of the grip, must be of a substantially larger cross-section than the cross-section of a conventional shaft. In the elliptical preferred embodiment, the major axis of the ellipse is 1.75 inches and the minor axis is about one inch. In contrast, the maximum outside diameter of a conventional golf shaft is about one-half inch. Adding weight on the outside of the shaft, such that the cross-sectional dimensions of the weight far exceed the cross-sectional dimensions of the shaft, has a dramatic effect on the moment of inertia of the club about the axis defined by the shaft. The moment of inertia of a body is directly proportionate to the body's mass multiplied by the square of the distance of the mass from the axis of rotation, as expressed by the following equation:

$$i=\Sigma mr2,$$

where i is moment of inertia, m is mass, and r is the distance from the mass to the axis of rotation. Hence, as mass is placed further away from the axis of rotation, its effect on the moment of inertia about that axis is increased significantly. This is the basic concept behind heel-toe weighting of the club head. However, such weights are measured in grams or ounces. The grip according to the present invention may add pounds outward from the axis of rotation, effecting an increase of an order of magnitude (or more) of the moment of inertia of the whole golf club. As a result, the torque exerted on the club by an off-center hit will usually not be sufficient to overcome its high moment of inertia—the club's resistance to twisting is greatly increased. Simply put, the massive counterweight relative to the club head seemingly swallows or absorbs most torques exerted on the club at impact. Moreover, the increased inertia of the club in general similarly insulates the putting stroke from unintended or external forces, such as wind, jitters due to nervousness, and the like.

These dynamic characteristics may be considered in terms of the club's sweet spot. The effective size of the sweet spot of the club is directly related to the magnitude of the moment of inertia about the shaft. One may locate the sweet spot of a conventional club by grasping the shaft about midway with one hand and repetitively tapping along the face of the club head with one finger of the other hand until the head bounces straight back with no twisting. On a conventional putter, one may strike the club face only about one-sixteenth of an inch on either side of the center of the sweet spot without the club twisting. If this test is performed on the present invention, one can strike the club's face along almost its entire length without the club twisting. This resistance to twisting is uncanny. As a result of the increased moment of inertia, the sweet spot of the club head is effectively enlarged.

In use, the putter is grasped by a golfer using conventional hand placement, that is, with each hand wrapping around the grip close to or touching the other hand, one hand above the other. This is the usual way in which a putter is grasped, and therefore puts the golfer in a familiar, comfortable position. In addition, because of the grip's large cross-section, the grip is comfortably placed within the creases of the palms of both of the golfer's hands, thus facilitating a commonly recommended putting-grip technique. Ideally, the grip is of uniform cross-section from its upper to lower end (i.e., not tapered), which further promotes palm placement in both hands. Moreover, because the center of gravity of the club lies within the grip, an instructive mark 35 can be placed on the grip to identify the location of the center of gravity and therefore assist the golfer in proper hand placement. Grasping an object by its center of gravity is a natural tendency for most people. This may be observed on any golf course, such as when one sees a golfer walking away from a green with his (conventional) putter and perhaps a wedge or two in hand, the golfer grasps these clubs near the bottom of their shafts, at their center of gravity, to achieve a sense of balance and make them easier to carry.

Further, in the elliptical preferred embodiment described above, having the major axis of the ellipse perpendicular to the face of the club head causes the golfer's thumbs to be guided into an optimal position on top of the grip, in line with the shaft, each time the golfer grips the club. Unlike a circle, the ellipse has parity, enabling this similar placement of hands relative to the putter blade every time. Further, with the major axis of the ellipse held along the target line of the putt (because the target line is perpendicular to the face), the palm-to-elbow-to-shoulder position is properly oriented and therefore conducive to a correct swing.

Figure 6:
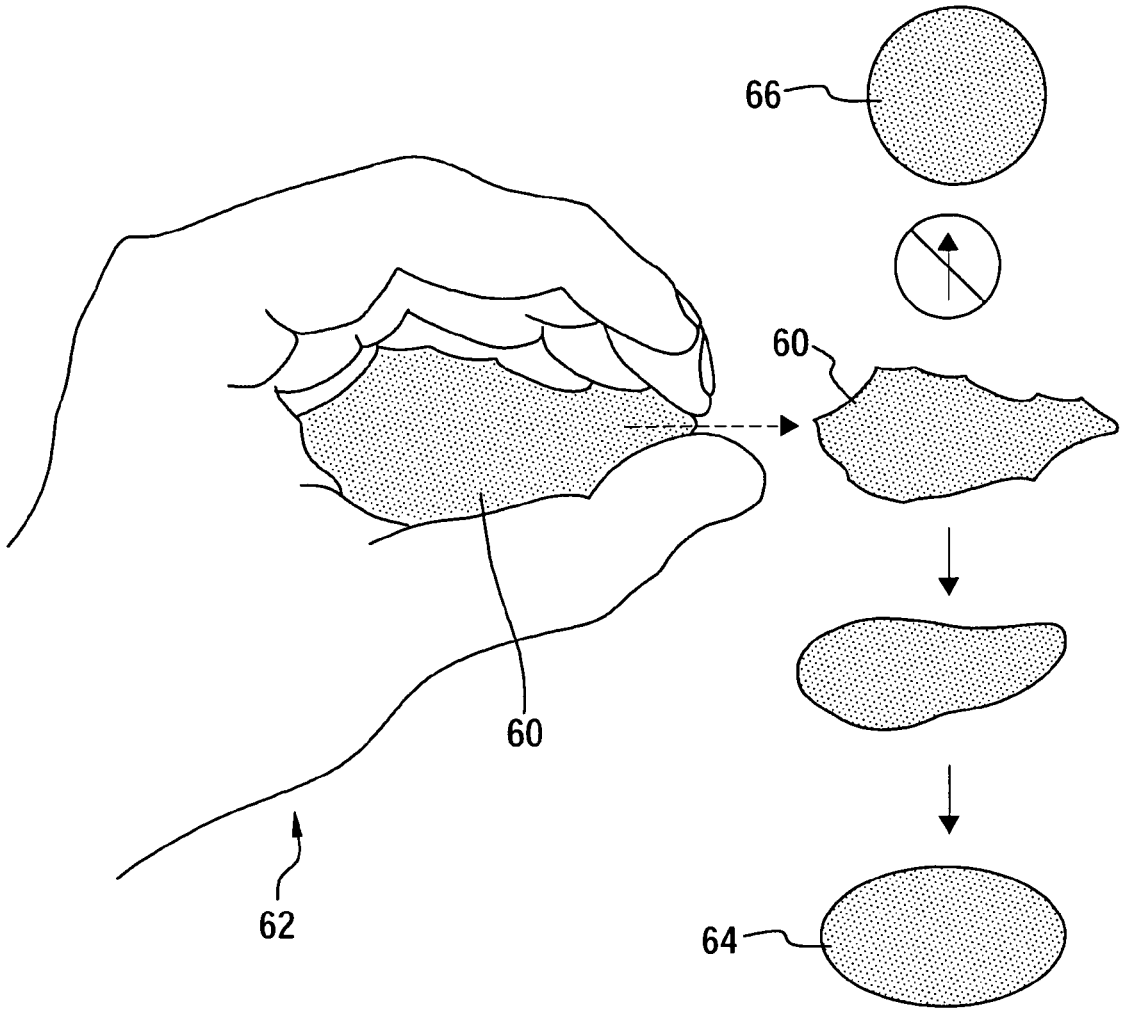
FIG. 6 is a front view of a relaxed human hand and shows how the opening formed by such a hand more closely approximates an ellipse than a circle.

This elliptical shape is a natural fit to the human hands. As an example, the hands of an astronaut sleeping in a near zero-gravity environment relax to a body-neutral position that is more adapted to hold a grip such as that of the present invention than a small, circular half-inch grip of a conventional putter. This point is illustrated further in FIG. 6. As shown in FIG. 6, the shape of the opening 60 formed by a relaxed human hand 62 much more closely approximates an ellipse 64 than it does a circle 66, which is closer to the predominate cross-sectional shape of most conventional golf grips. This large elliptical cross-section, as well as a large cross-section in other shapes, has several benefits. First, the large cross-section decreases the tendency of the golfer to over-grip or clench the club with his fingers. The golfer grips the club primarily with his palms in a natural, more relaxed position, causing the grip pressure to be lessened. This lightened grip pressure, which is preferred by most golf instructors, prevents cramping. In addition, holding the club in the palms allows the fingers to be used for touch and feel, rather than their being the principal support for the club as in a conventional grip. Also, the larger diameter grip promotes less unintended wrist movement in the stroke, which is the commonly preferred method of putting. However, the above advantages also benefit those golfers consciously utilizing wrist action in their stroke. (It should be noted that an ellipse has no concavity, a concave grip being against the rules of golf.)

If a golfer opens both of his hands, palms up, the grip of a putter according the present invention can be placed on the platform formed by the two palms, and the putter will remain in its initial static position. Because the center of gravity of the whole club is squarely supported by the palms, the golfer will not feel the putter pivoting toward the ground. The club head appears seemingly weightless. In fact, due to the weight of the grip and the center of gravity being located over the palms, the frictional force between the grip and the hands will hold the putter in place on the golfer's open palms (without using the thumbs), even as the palms and the putter are rotated to a near vertical position. This effect translates positively to the actual putting stroke. As the golfer stands above the ball at address, the club does not feel bottom heavy. An angular torque by the club head is not felt on the golfer's hands; the golfer does not feel as if gravity is prying or pulling the club from his hands. The golfer does not have to exert differing forces by each hand just to keep the club head from falling back towards his feet and away from the ball. Rather, the grip sits securely in the golfer's relaxed hands, and the club head seems to float in space. As a result, the golfer can easily place the club head in the desired position behind the ball and hold it there during address—without relying on the small, twitchy muscles of the hands and forearms.

As the golfer addresses the ball and swings the club, several other advantages of the massiveness of the present invention become apparent. The heavy balanced weight causes the biomechanical process of ulnar deviation in the top gripping hand. This process locks the wrist joint, normally free to rotate in many directions, on track to move only in the desired target plane. Further, the pressure is taken off the small, twitchy muscles of the wrists and forearms. The putter now primarily engages the large, reliable muscles of the upper arms, shoulders, and back—the putter simply hangs down from the golfer's upper body. These muscles are more reliable under pressure, are less susceptible to unintentional forces (e.g., wind, fatigue, stress, involuntary muscle action, jitters of age, and the like), and are more conducive to an easily controlled pendulum stroke. These benefits may be attributable to the fact that the heavy counterweight is more likely to engage the slow-twitch cells of these larger muscles, which normally carry heavy loads, rather than activating fast-twitch muscle cells. Slow-twitch cells produce a more accurate "slow twitch," which develop tension first, whether the resulting movement is slow or fast. The slow-twitch cells therefore stay in control of the tension, not allowing the inaccurate fast-twitch threshold to activate. Also, certain large muscles, such as the back muscles, act and are biomechanically referred to as "stabilizers." The heavy weight of the club will pull these back muscles taut and prevent unintended body sway. Furthermore, according to basic laws of physics, a rigid body can be suspended in any orientation from its center of gravity without tending to rotate. Accordingly, the present invention, which is a rigid body and is suspended from its center of gravity, does not have a tendency to rotate uncontrollably, further increasing the steadiness and accuracy of the club.

Once the putter is set in motion along the target line, it tends to remain in motion toward the target. Because of its high mass, and therefore great inertia, stronger forces are needed to disrupt its path along the target line than are needed for a conventional prior art club. As noted above, the greater mass and larger muscles facilitate a pendulum swing. In fact, because the center of gravity of the whole club is in the grip, the club is effectively held by the pendulum's bob, locking the handle end of the club on track and thus further optimizing the preferred single-pendulum swing. The putter is swung as a bob between the hands, and the head and shaft can be thought of as minor mass attachments to that bob. Simply put, they only come along for the ride, which effects an extreme simplification of the dynamics of the putting stroke. There is no lightweight handle to leave a heavier club head behind when using a putter according to the present invention. Instead, the grip and the head both have the same inertia relative to the hands, and therefore the putter pulled uniformly by both hands will move uniformly at every part of its length. If one considers an imaginary line from the club head, through the putter's shaft and continuing to the middle of the golfer's shoulders, the angular acceleration of every point on this line is the same. This consistency leads to increased accuracy, and more putts are made.

Also, because the center of gravity is within the boundaries of the gripping hands, the distance from each hand to the center of gravity is equal or very nearly equal relative to a conventional putter. Therefore, the golfer can apply equal forces through each hand during the putting stroke; he does not need to balance a bottom-heavy club against gravity with differing forces by each hand and at the same time vary these forces as he guides the club head through the putting stroke. Dissonant forces are minimized or eliminated. The putter in the golfer's hands is, or very nearly approaches, a state of neutral equilibrium.

Finally, as the club head strikes the ball, the high moment of inertia of the club dramatically reduces the likelihood of the club twisting if there is an off-center hit. As described above, the sweet spot of the club head is effectively enlarged. Because of this large sweet area, a ball hit anywhere on the club's face will go approximately the same distance as a ball hit in precisely the center of the face. This consistent feedback improves the golfer's ability to judge distances and his ability to read greens. Also, the large counterweight acts as a buffer to dampen any vibration from an off-center hit, leading to a overall better feel to the club.

The many advantages arising from the present invention—including the overall ergonomics of the club; the light-pressured palm grip; the repeatable accurate hand placement guided by the ellipse; the correct orientation of the palms, elbows, and shoulders; the locking of the wrist; the apparent weightlessness of the club head; the club's neutral equilibrium; the use of the larger, reliable muscles of the upper arms, shoulders, and back; the great inertia of the club itself; the equality of forces applied through each hand; and the great moment of inertia of the club about its shaft axis—contribute to twin results: more accurate, repeatable, and reliable putting, and above all else, enjoyment of the game.

Although the present invention has been described in considerable detail with reference to certain preferred embodiments thereof, other embodiments are possible. The foregoing description is therefore considered in all respects to be illustrative and not restrictive. In many places it refers to putters and the putting stroke. Indeed, a putter is a preferred embodiment of the present invention. However, the principles of the invention may be applied to other golf clubs, particularly clubs used for chipping and pitching, and therefore the present invention should not be considered restricted solely to putters. Likewise, a new shaft could be designed with an extreme flare at its handle end, such that the weight could be added to the interior of the shaft. Upon reading the foregoing disclosure, this and other variations would be apparent to those skilled in the art. Therefore, the present invention should be defined with reference to the appended claims and their equivalents, and the spirit and scope of the claims should not be limited to the description of the preferred embodiments contained herein.

I claim:

1. A golf club about 30 to 40 inches in length, said club comprising:

a shaft with a lower head end and an upper handle end;

a club head attached to the head end;

a grip of about seven to fifteen inches in length attached to the handle end comprising a counterweight fitting over the handle end of the shaft; and an elongate lower support, being less dense than the counterweight, fitting over the shaft below the counterweight;

the counterweight having sufficient mass such that the center of gravity of the golf club lies within the grip.

2. The golf club of claim 1 wherein said lower support is adjacent to the counterweight.

3. The golf club of claim 1 wherein the cross section of the lower support is different than the cross section of the counterweight.

4. The golf club of claim 1 wherein the cross section of the grip is asymmetric.

5. The golf club of claim 1, further comprising an outer covering over said counterweight and wherein said lower support is made of the same material as said outer covering.

6. The golf club of claim 5 wherein said outer covering is made from a material selected from the group consisting of a curable resin, a curable epoxy, and a curable polymer and wherein said grip is made by placing said shaft with said counterweight in its desired location into a mold having the desired shape of said grip, filling said mold with said material, and curing said material in said mold, whereby said outer covering and said lower support are formed by said cured material.

7. A golf club about 30 to 40 inches in length, said club comprising:

a shaft with a lower head end and an upper handle end;

a club head attached to the head end;

a grip of about seven to fifteen inches in length attached to the handle end comprising a counterweight fitting over the handle end of the shaft;

an outer covering over said counterweight; and an elongate lower support, being less dense than the counterweight and made of the same material as said outer covering, fitting over the shaft below the counterweight;

the counterweight having sufficient mass such that the center of gravity of the golf club lies within the grip;

and wherein said outer covering is made from a material selected from the group consisting of a curable resin, a curable epoxy, and a curable polymer, said counterweight having a longitudinal bore sufficiently larger in diameter than said shaft such that there is a space between said bore and said shaft, and wherein said grip is made by placing said shaft with said counterweight in its desired location into a mold having the desired shape of said grip, filling said mold with said material, and curing said material in said mold, whereby said outer covering and said lower support are formed by said cured material and wherein said material fills said space between said bore and said shaft and cures therein.

8. A golf club less than 40 inches in length, said club comprising:

a shaft with a lower head end and an upper handle end;

a club head attached to the head end;

a grip of about seven to fifteen inches in length attached to the handle end comprising a counterweight fitting over the handle end of the shaft; and an elongate lower support comprising a hollow member extending downward from said counterweight over the shaft;

the counterweight having sufficient mass such that the center of gravity of the golf club lies within the grip.

9. The golf club of claim 8 wherein said hollow member is made of the same material as said counterweight.

10. The golf club of claim 8, further comprising an outer covering over said counterweight, and where said hollow member is made from the same material as said outer covering.

11. A counterweighted grip for a golf club about 30 to 40 inches in length having a shall with a lower head end and an upper handle end, a club head attached to the head end, said grip to be attached to the handle end, said grip comprising:

a counterweight having a longitudinal bore for receiving shafts of varying sizes;

an elongate lower support, being less dense than the counterweight, having a longitudinal bore for receiving shafts of varying sizes and for placement below the counterweight, said counterweight and elongate lower support together being about seven to fifteen inches in length; and a curable fill material for disposal in the space between a shaft and the bores of said counterweight and said lower support;

the counterweight having sufficient mass such that the center of gravity of the golf club lies within the grip.

* * * * *